US008478116B2

(12) United States Patent
Henry et al.

(10) Patent No.: US 8,478,116 B2
(45) Date of Patent: Jul. 2, 2013

(54) IMMERSION HEATER WITH EXHAUST PATH FOR OVERPRESSURE

(75) Inventors: Sam W. Henry, Ogden, UT (US); Paul Neilson, Pleasant View, UT (US); Gary Cook, Plain City, UT (US)

(73) Assignee: Chromalox, Inc., Pittsburgh, PA (US)

( * ) Notice: Subject to any disclaimer, the term of this patent is extended or adjusted under 35 U.S.C. 154(b) by 887 days.

(21) Appl. No.: 12/542,834

(22) Filed: Aug. 18, 2009

(65) Prior Publication Data

US 2011/0042387 A1 Feb. 24, 2011

(51) Int. Cl.
*F24H 1/20* (2006.01)

(52) U.S. Cl.
USPC ..... 392/453; 392/441; 392/455; 392/497

(58) Field of Classification Search
USPC ..... 392/441–464
See application file for complete search history.

(56) References Cited

U.S. PATENT DOCUMENTS 411,737 A * 9/1889 Smith ..... 392/401
1,124,548 A * 1/1915 Steller ..... 219/526
1,356,335 A * 10/1920 Bernard ..... 219/536
1,360,510 A * 11/1920 Elliott ..... 219/544
1,406,994 A * 2/1922 Moffat ..... 219/550
1,703,532 A * 2/1929 Hynes ..... 219/536
1,715,287 A * 5/1929 Head ..... 338/285
1,731,058 A * 10/1929 Pierson ..... 392/501
1,787,450 A * 1/1931 Lonergan ..... 392/453
1,817,850 A * 8/1931 Schwalbach ..... 219/205
2,536,747 A * 1/1951 Hynes ..... 392/453
4,593,178 A * 6/1986 Banta et al. ..... 392/453
5,844,211 A * 12/1998 Henry et al. ..... 219/523
2002/0015585 A1 * 2/2002 Jensen et al. ..... 392/485

* cited by examiner

*Primary Examiner* — Thor Campbell
(74) *Attorney, Agent, or Firm* — K&L Gates LLP

(57) ABSTRACT

Disclosed is a heating unit which can comprise a tube, or pipe, having an aperture therein which can be configured to receive a heating element. In various embodiments, the heating element can comprise a resistive element which can be configured to generate heat when a voltage differential is applied thereto. In certain embodiments, the heating unit can further comprise a collar which is threadably engaged with the tube, wherein a flame path, or exhaust path, can be defined between threads on the pipe and threads on the collar, for example. In certain embodiments, the flame path can comprise a passageway defined between the circumference, or perimeter, of the tube and the collar. Such a flame path can be configured to allow pressurized gasses to safely escape from the tube along a predetermined path.

24 Claims, 11 Drawing Sheets

IMMERSION HEATER WITH EXHAUST PATH FOR OVERPRESSURE

BACKGROUND

1. Field of the Invention

The present invention generally relates to immersion heaters, or heating units.

2. Description of the Related Art

In various circumstances, fluids, liquids, gasses, vapors, solids, and/or any other suitable substances may be stored in a tank or storage container. Such substances can comprise water, biodiesel, glycerin, ethanol, asphalt, fuel oil, pitch and tar, liquid sugar, lube oils, linseed oil, animal fats, and/or any heat sensitive compound, for example. Other substances can comprise granular solids and/or colloids, for example. In many circumstances, these substances may need to be heated and, in some circumstances, one or more heating units may be positioned within the tank or storage container in order to heat the substances. The heating units can be positioned within the tank such that at least a portion of the heating units are immersed in the substance. In various embodiments, each heating unit can comprise a heat transfer surface which is heated by a heating element. In certain embodiments, the substance can flow over the heat transfer surface such that heat can be transferred from the heating unit to the substance. Various heating units, such as the Model LTFX immersion heaters, for example, are available from Chromalox, Inc., Pittsburgh, Pa.

The foregoing discussion is intended only to illustrate various aspects of the related art in the field of the invention at the time, and should not be taken as a disavowal of claim scope.

SUMMARY

In at least one form, a heating unit can comprise a tube, or pipe, having an aperture therein which can be configured to receive a heating element. In various embodiments, the heating element can comprise a resistive element which can be configured to generate heat when a voltage differential is applied and current flows therethrough. In certain embodiments, the heating unit can further comprise a collar which is threadably engaged with the tube, wherein a flame path, or exhaust path, can be defined between threads on the pipe and threads on the collar, for example. In certain embodiments, the flame path can comprise a passageway defined between the circumference, or perimeter, of the tube and the collar. Such a flame path can be configured to allow pressurized gasses, for example, to safely escape from the tube aperture along a predetermined path. Such pressurized gasses may be created when combustible vapors or gasses enter into the tube aperture and come into contact with the resistive element of the heating element.

In at least one form, a heating unit can comprise a tube, or pipe, having an aperture therein which can be configured to receive a heating element. In various embodiments, the heating unit can further comprise a flange mounted to the tube for mounting the tube to a tank and, in addition, a connector mounted to the tube which can be configured to support a portion of the heating element. In certain embodiments, a flame path, or exhaust path, can be defined between the connector and the heating element mounted thereto. Similar to the above, such a flame path can be configured to allow pressurized gasses, for example, to safely escape from the tube aperture along a predetermined path. In various embodiments, the flame path can comprise a first portion which extends in a first direction and a second portion which extends in a second direction. In at least one embodiment, the flame path can be tortuous and comprise one or more turns in order to control the exhaust of the pressurized gasses, for example.

This Summary is intended be briefly outline certain embodiments of the subject application. It should be understood that the subject application is not limited to the embodiments disclosed in this Summary, and is intended to cover modifications that are within its spirit and scope, as defined by the claims. It should be further understood that this Summary should not be read or construed in a manner that will act to narrow the scope of the claims.

BRIEF DESCRIPTION OF THE DRAWINGS

The above-mentioned and other features and advantages of the various embodiments of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate various embodiments of the invention, in one form, and such exemplifications are not to be construed as limiting the scope of the invention in any manner.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Figure 1:
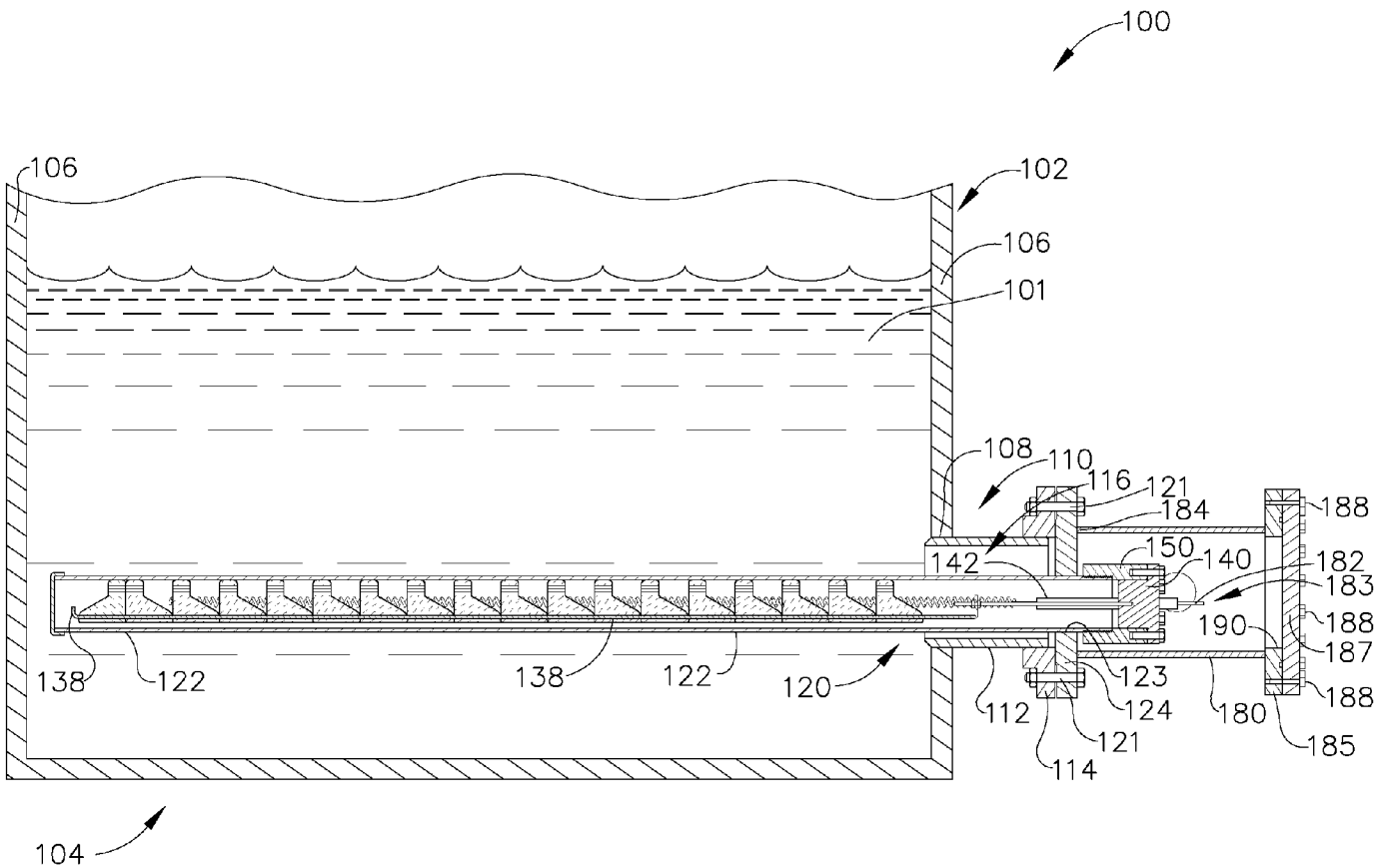
FIG. 1 is a cross-sectional view of a tank containing a fluid and, in addition, a heating unit mounted to the tank in accordance with at least one embodiment of the present invention.

In various embodiments, as discussed above, fluids, liquids, gasses, vapors, and/or solids, for example, may be stored in a tank and/or any other suitable storage container. In many circumstances, these substances may need to be heated and, in some circumstances, one or more heating units may be positioned within the tank in order to heat the substances. Referring now to FIG. 1, storage tank 100 comprises a top 102, a bottom 104, and a sidewall 106. Although top 102 is illustrated as being open and bottom 104 is illustrated as being closed, any suitable tank configuration can be used. Furthermore, although sidewall 106 can be cylindrical, or at least substantially cylindrical, for example, any suitable shape can be used. In any event, as illustrated in FIG. 1, tank 100 can be configured to contain a fluid, such as fluid 101, for example, therein.

In various embodiments, referring again to FIG. 1, storage tank 100 can further comprise at least one aperture, such as aperture 108 in sidewall 106, for example, which can be configured to receive a heating element therein. In certain embodiments, referring now to FIG. 2, tank 100 can also comprise at least one mating flange, such as mating flange 110, for example, which can extend from sidewall 106. In at least one embodiment, mating flange 110 can comprise a neck 112 welded to sidewall 106 and, in addition, a bolt plate 114 integrally formed with and/or attached to neck 112. In at least one such embodiment, mating flange 110 can further comprise an aperture, such as aperture 116, for example, extending therethrough which can be aligned, or at least substantially aligned with aperture 108 when mating flange 110 is mounted to sidewall 106. In at least one embodiment, referring again to FIG. 2, at least a portion of neck 112 can be positioned within aperture 108 of sidewall 106 such that neck 112 can be welded to sidewall 106 on the inside surface and/or outside surface of sidewall 106 in order to create a fluid-tight seal between sidewall 106 and flange 110.

In various embodiments, referring once again to FIGS. 1 and 2, a heating unit, such as heating unit 120, for example, can comprise a tube, or pipe, 122, and a mounting portion 124 mounted to pipe 122. Pipe 122 can be sized and configured such that at least a portion of pipe 122 can be inserted into tank 100 through aperture 116 of mounting flange 110. In various embodiments, pipe 122 can be comprised of 2" Schedule 40 pipe, 3" Schedule 40 pipe, and/or any other suitable NPS (nominal pipe size) and/or Schedule, for example, and can be comprised of any suitable material, such as carbon steel and/or stainless steel, for example. In certain embodiments, although not illustrated, pipe 122 can be supported by one or more sidewalls of aperture 116. In various embodiments, mounting portion 124 can be suitably attached to pipe 122 such that, when mounting portion 124 is mounted to bolt plate 114, for example, pipe 122 can be suspended within aperture 116 and otherwise properly positioned within tank 100. In at least one embodiment, mounting portion 124 can comprise a flange having a plurality of bolt apertures 125 (FIG. 3) which can be aligned with bolt apertures in bolt plate 114 such that bolts 121 (FIG. 2), and/or any other suitable fasteners, can be inserted through the bolt apertures 125 in order to secure mounting portion 124 to mating flange 110.

In various embodiments, further to the above, bolt apertures 125 and the bolt apertures in bolt plate 114 can comprise through-holes configured to permit bolts 121, and/or any other suitable fasteners, to extend therethrough such that ends of the bolts 121 can receive one or more nuts, and/or any other suitable retaining members, thereon. Such retaining members, in co-operation with the bolts, can be tightened in order to clamp mounting portion 124 and bolt plate 114 together. In various embodiments, such arrangements can comply with ANSI 75#, 150#, and/or 300# pressure classes, for example. In certain other embodiments, although not illustrated, the bolts can be inserted through bolt apertures 125 and threadably engaged with the bolt apertures in bolt plate 114 in order to secure mounting portion 124 to mating flange 110. In any event, mounting portion 124 can be secured to flange 110 such that a fluid-tight seal is created therebetween. In certain embodiments, although not illustrated, a seal, or gasket, can be positioned intermediate mounting portion 124 and bolt plate 114 which can prevent, or at least inhibit, fluid 101 within tank 100 from leaking through the interface between mounting portion 124 and bolt plate 114. Such a seal can be compressed between mounting portion 124 and bolt plate 114 when fasteners are used to secure the mounting portion 124 to bolt plate 114. In various embodiments, the seal can be comprised of rubber, plastic, silicone, an elastomeric material, and/or any other suitable material.

In various embodiments, as described above, mounting portion 124 can be attached to pipe 122 such that, when mounting portion 124 is mounted to bolt plate 114, pipe 122 can be properly positioned within tank 100. Mounting portion 124 can be welded, brazed, press-fit, thermal-fit, and/or otherwise suitably attached to pipe 122. In certain embodiments, referring to FIGS. 1 and 2, mounting portion 124 can comprise a flange having a pipe-receiving aperture 123 therein wherein the pipe-receiving aperture 123 can be sized and configured such that, when pipe 122 is positioned within the pipe-receiving aperture 123, any gap between pipe 122 and mounting portion 124, if one exists, can be sealed. In various embodiments, a weld used to connect mounting portion 124 to pipe 122 can also be utilized to create a fluid-tight seal between pipe 122 and mounting portion 124. In certain embodiments, an epoxy, for example, can be applied to and/or within a seam between pipe 122 and mounting portion 124 to create a fluid-tight seal therebetween. In any event, such a seal can prevent, or at least inhibit, fluid 101 within tank 100 from leaking through the interface between pipe 122 and mounting portion 124.

Figure 2:
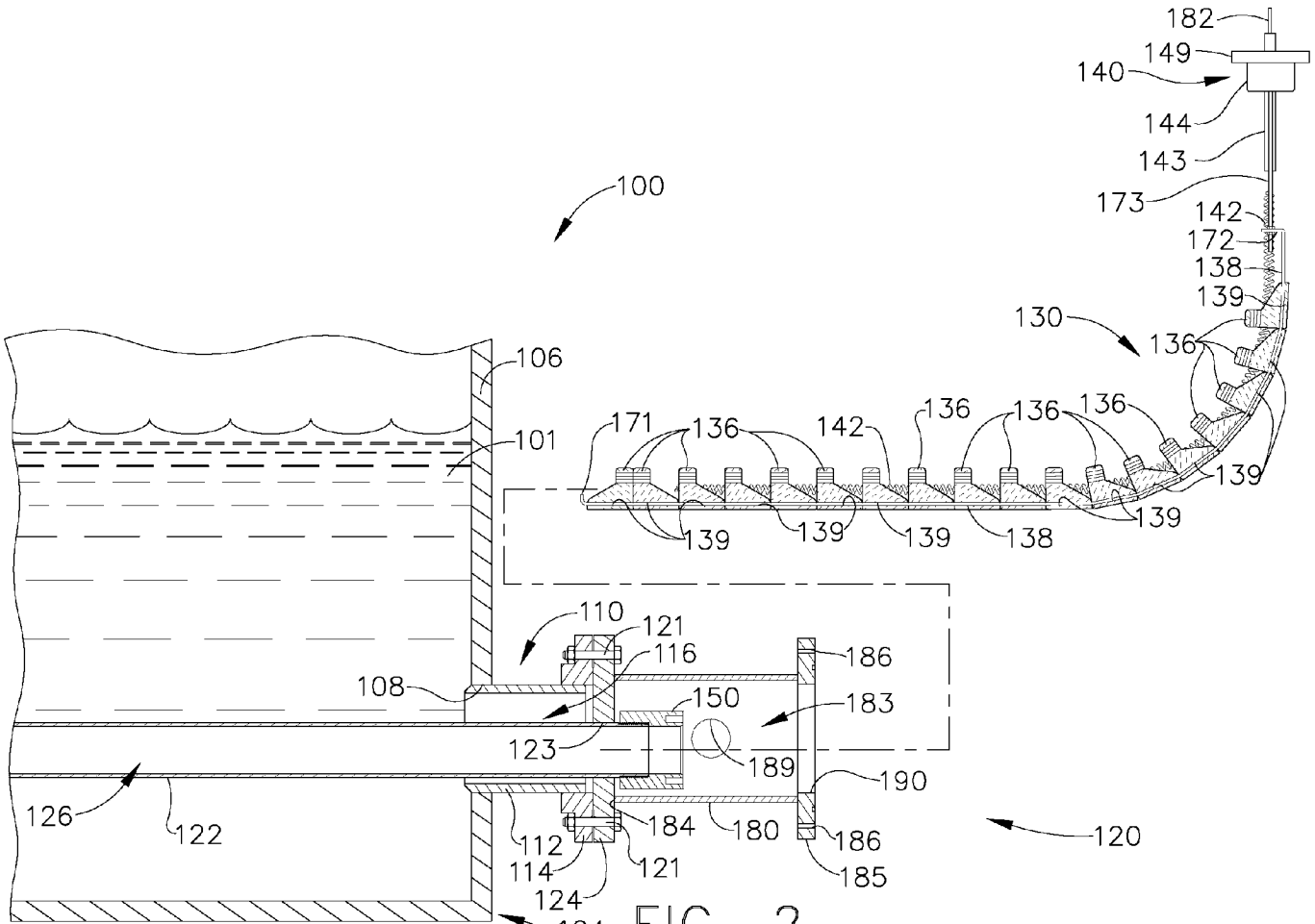
FIG. 2 is a partial exploded view of the heating unit of FIG. 1 illustrated with some components removed and some components illustrated in cross-section.
Figure 3:
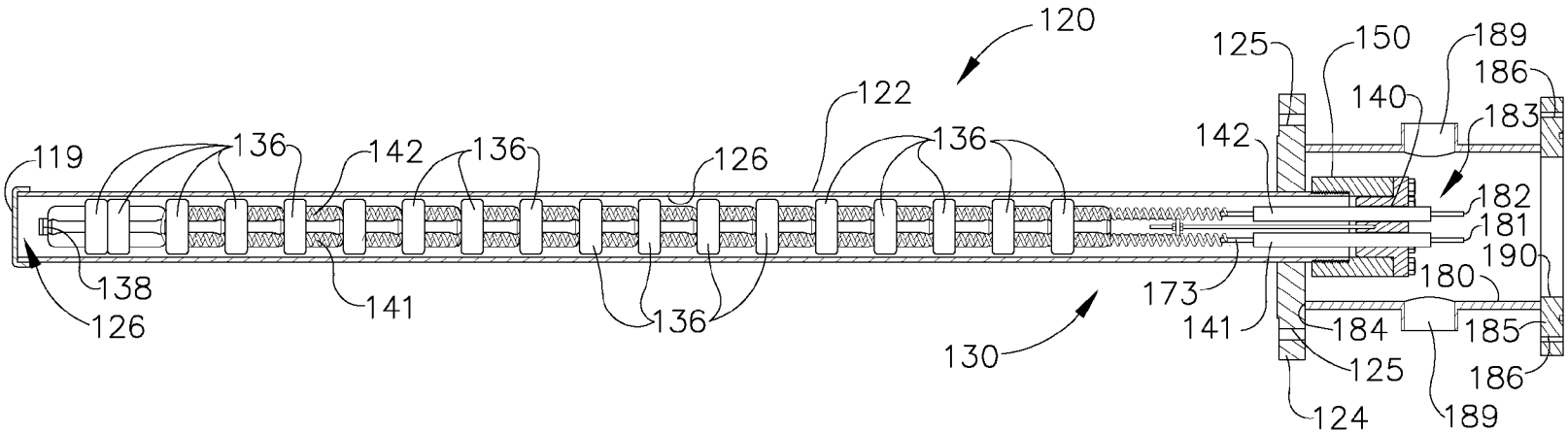
FIG. 3 is a cross-sectional view of the heating unit of FIG. 1.
Figure 4:
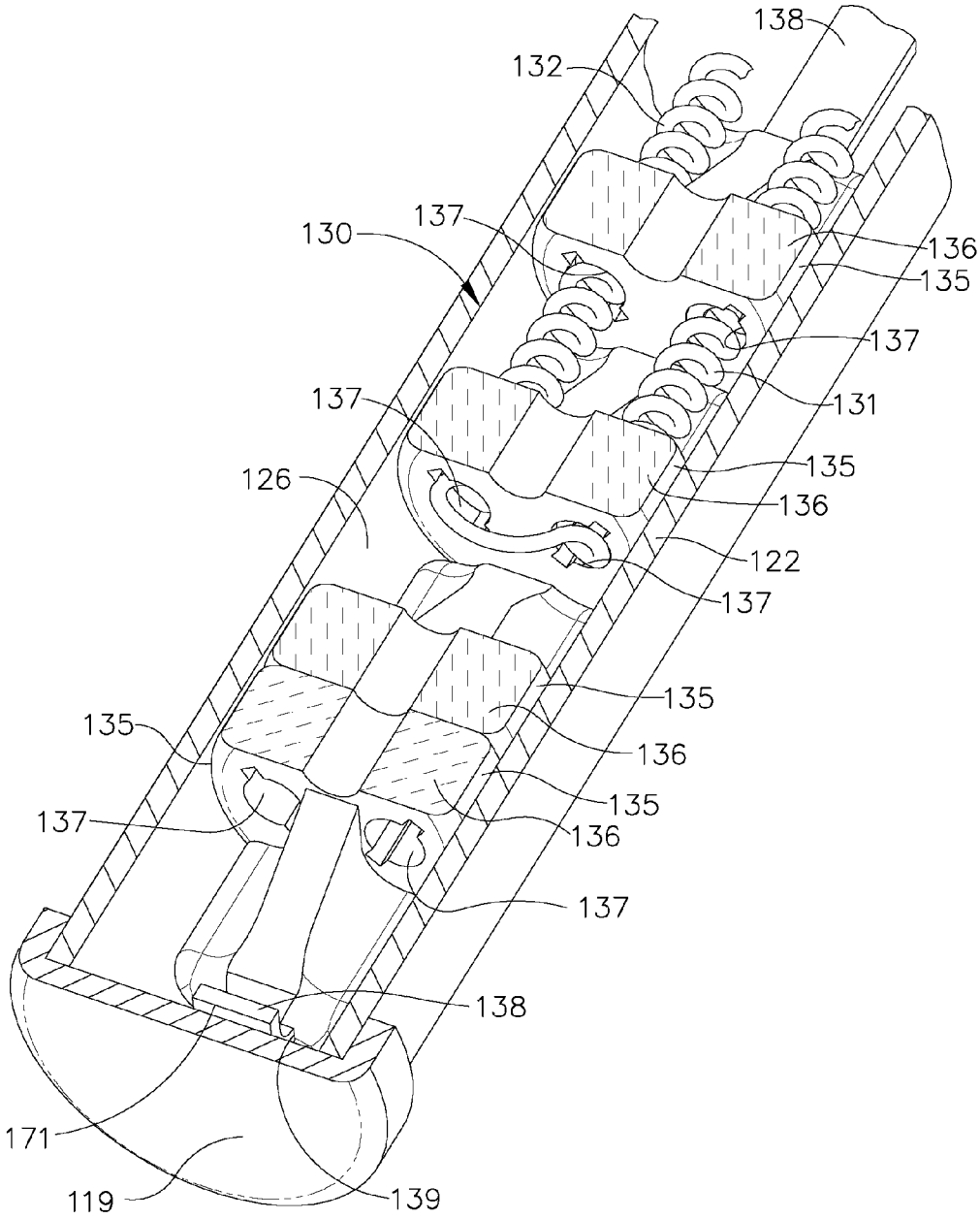
FIG. 4 is a cross-sectional view of a distal end of the heating unit of FIG. 1.

In various embodiments, referring primarily now to FIGS. 2-4, heating unit 120 can further comprise a heating element assembly 130 which can be at least partially positioned within aperture 126 in pipe 122. Heating element assembly 130 can comprise one or more resistive elements, such as a conductors, wires, and/or filaments, for example, and, in addition, one or more insulative elements configured to support the resistive elements within the pipe 122. In at least one embodiment, heating element assembly 130 can comprise a first resistive element 131 and a second resistive element 132, wherein a voltage differential can be applied between the first resistive element 131 and the second resistive element 132 such that current can flow through a circuit comprising the first resistive element 131 and the second resistive element 132 and generate heat. More particularly, in various embodiments, the resistive elements 131 and 132 can each be comprised of wire having a sufficient diameter and/or length such that a sufficiently high resistance is created within the circuit and, as a result, heat is generated by the current flowing through the wires. In at least one embodiment, resistive elements 131 and 132 can each be comprised of a coiled wire having ends which are attached to one another by a conductive connector. In certain embodiments, referring to FIG. 4, resistive elements 131 and 132 can comprise one long continuous wire wherein, in such embodiments, a first half of the wire can be referred to as a first resistive element and a second half of the wire can be referred to as a second resistive element.

In various embodiments, further to the above, heating element assembly 130 can further comprise one or more insulative elements, such as insulative members 136, for example, which can be configured to support resistive elements 131, 132 within aperture 126 in pipe 122. In at least one embodiment, referring again to FIG. 4, insulative members 136 can have an outer perimeter 135 which can be configured to contact or engage the inner surface of aperture 126, wherein, in certain embodiments, insulative members 136 can support resistive elements 131, 132 such that they do not contact, or short to, pipe 122. More particularly, in at least one embodiment, resistive elements 131, 132 can be comprised of one or more uninsulated copper wires, for example, wherein insulative members 136 can be comprised of a non-electrically conductive, or insulative, material, such as ceramic, for example, which can support the conductive wires. In various circumstances, the resistive wires of resistive elements 131, 132 can be referred to as jumper wires. In various embodiments, insulative members 136 can provide significant dielectric resistance between resistive elements 131 and 132, for example, and/or between resistive elements 131, 132 and pipe 122, for example. Insulative members comprised of ceramic can also withstand the heat generated by the resistive elements 131 and/or 132, for example. In certain embodiments, although not illustrated, resistive element 131 and/or second resistive element 132 can comprise an insulative jacket which can prevent, or at least inhibit, resistive element 131 and/or resistive element 132 from shorting to pipe 122 and/or to each other, for example. In at least one such embodiment, the resistive elements may be positioned within a pipe without being supported by insulative members.

In various embodiments, further to the above, insulative members 136 can comprise one or more apertures 137 in which resistive element 131 and/or resistive element 132 can be positioned. In at least one such embodiment, the apertures 137 of adjacent insulative elements 136 can be aligned, or at least substantially aligned, with one another such that the resistive elements 131, 132 can extend along opposite, or at least substantially opposite, sides of the heating element assembly 130. In certain embodiments, the apertures 137 can be aligned along and/or with respect to one or more axes. In various embodiments, the arrangement and alignment of insulative members 136 can be maintained by one or more alignment shafts or members. In at least one embodiment, referring to FIGS. 4 and 5, heating element assembly 137 can further comprise an alignment, or support, member 138, for example, which can extend through apertures, or slots, 139, for example, within insulative members 136. In at least one such embodiment, alignment member 138 can be configured to prohibit, or at least limit, relative lateral movement between adjacent insulative members 136 and/or between insulative members 136 and alignment member 138. In certain embodiments, alignment member 138 can be engaged within slots 139, for example, in a friction-fit, or press-fit, manner. Further to the above, alignment member 138 can be sufficiently flexible, or resilient, to allow the ends of heating element assembly 130 to be bent toward one another, as illustrated in FIG. 2, for example, and then spring back to their original position, as illustrated in FIG. 1. In various circumstances, flexible alignment member 138 may allow heating element assembly 130 to be inserted into pipe 122 with limited clearance surrounding tank 100, for example. More particularly, the alignment member 138 may be configured to allow the heating element assembly 130 to be bent in an approximately 36" radius of curvature which can allow the heating element assembly 130 to be inserted into tank 100 even though a building wall, for example, may be nearby. Such embodiments may be especially helpful in embodiments where heating element assembly 130 is approximately 25 feet in length, for example. In various embodiments, alignment member 138 can comprise a rectangular cross-section which can allow heating element assembly 130 to be more easily flexed in certain directions as compared to other directions.

Figure 5:
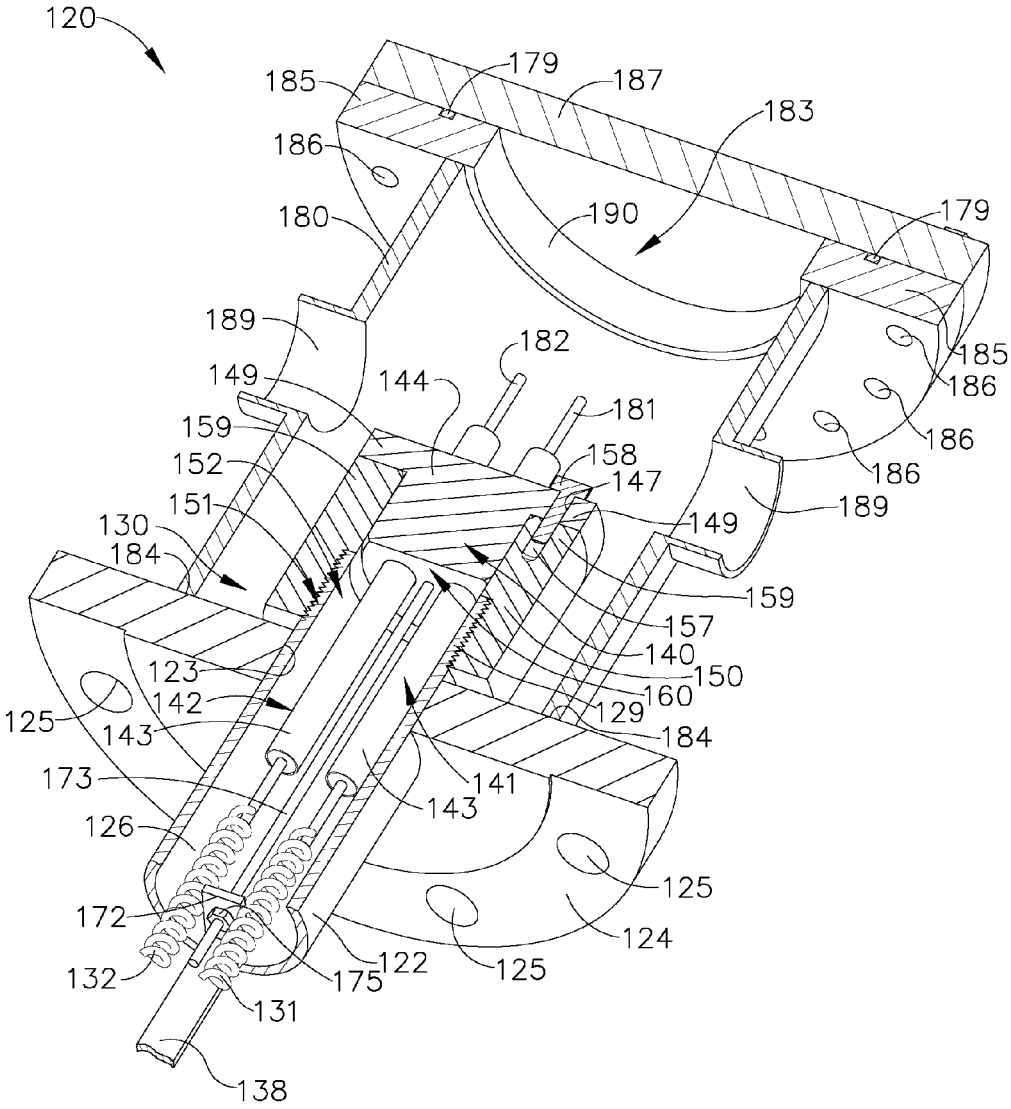
FIG. 5 is a cross-sectional view of a proximal end of the heating unit of FIG. 1.

In various embodiments, referring again to FIG. 4, alignment member 138 can comprise a distal end 171 which can extend laterally with respect to an axis defined by alignment member 138 so as to provide a distal stop, or support, for the insulative elements 136. In at least one embodiment, the distal end of alignment member 138 can be bent laterally. Referring now to FIG. 5, alignment member 138 can comprise a proximal end 172 which can extend laterally so as to provide a mounting portion for mounting the alignment member 138 to heating unit 120. Similar to the above, the proximal end of alignment member 138 can be bent laterally. In at least one embodiment, referring to FIGS. 6 and 7, the heating unit 120 can further comprise a mounting rod 173 which can be threadably engaged with a threaded aperture in proximal end 172 and a threaded aperture 174 in terminal block 140. In at least one embodiment, the entirety of mounting rod 173 can be threaded while, in other embodiments, only portions of mounting rod 173 may be threaded. In any event, in various embodiments, one or more locking members, such as nut 175, for example, can be threadably engaged with mounting 173 in order to lock alignment member 138 in position.

Figure 6:
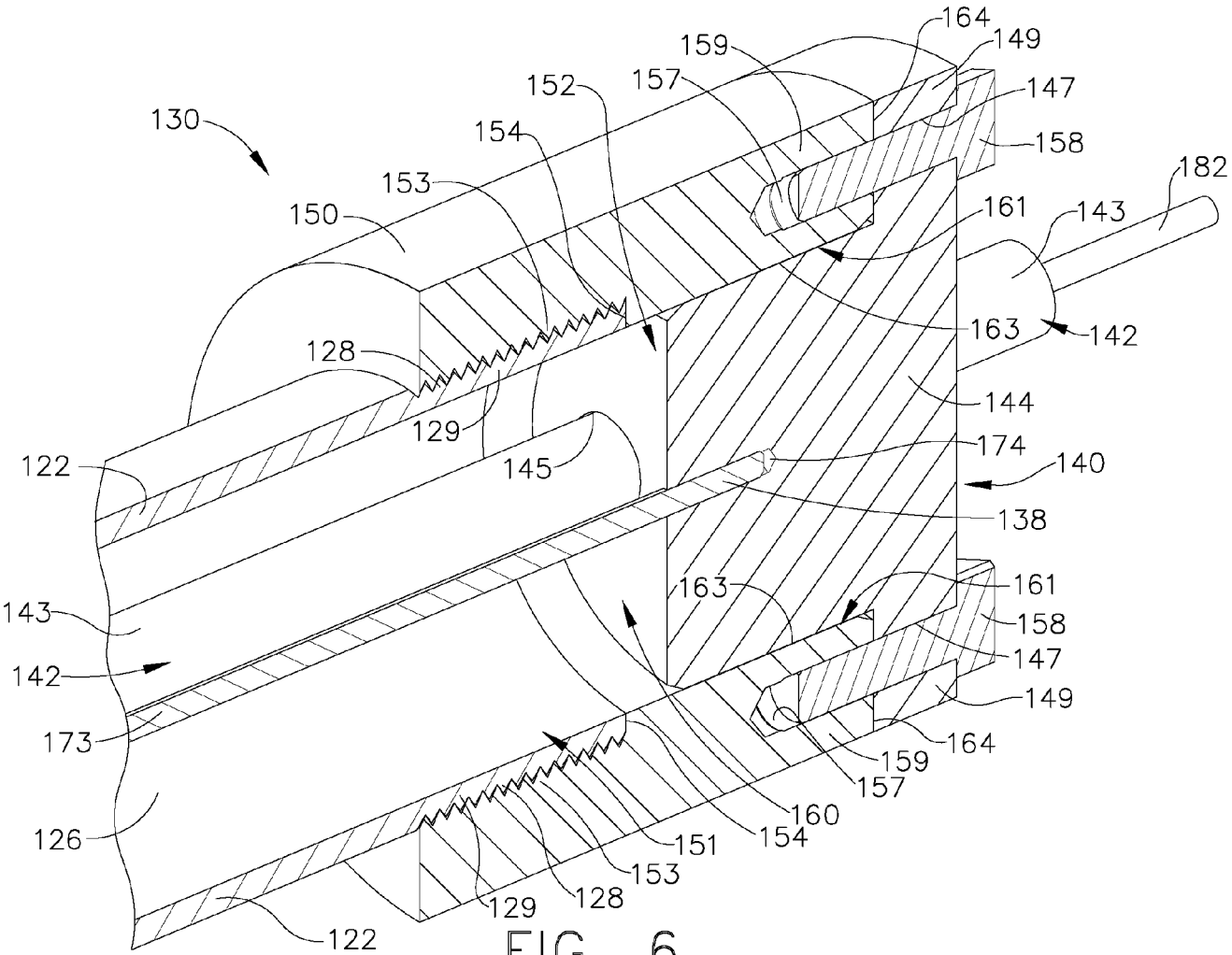
FIG. 6 is another cross-sectional view of the end of the heating unit illustrated in FIG. 5.
Figure 7:
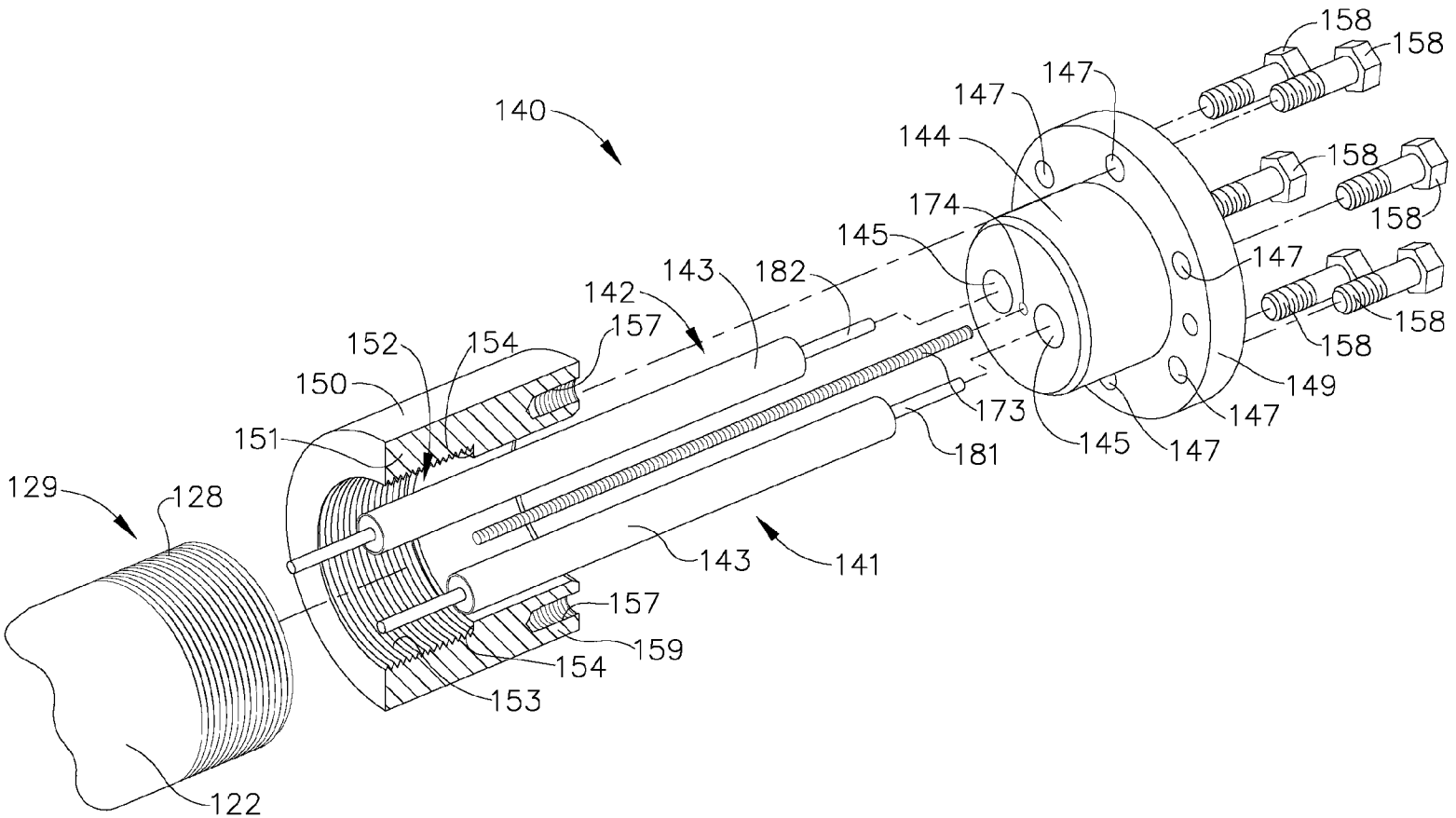
FIG. 7 is an exploded view of the end of the heating unit illustrated in FIG. 5.
Figure 11:
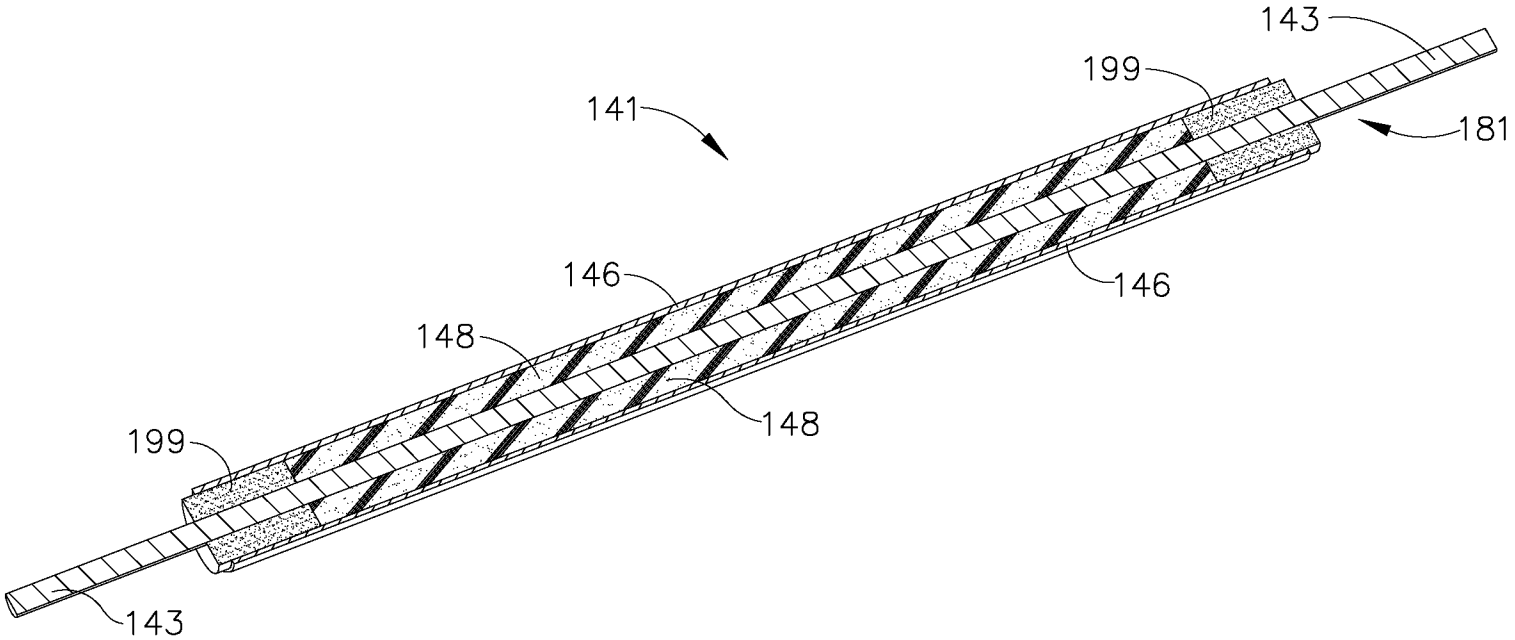
FIG. 11 is a cross-sectional view of a terminal in accordance with at least one embodiment.

In various embodiments, referring now to FIGS. 5-7, the heating unit 120 can further comprise a terminal block, such as terminal block 140, for example, which can comprise one or more terminals operably coupled to first resistive element 131 and/or second resistive element 132. In at least one embodiment, the terminal block 140 can comprise a body 144, a first terminal 141 operably coupled with first resistive element 131 and a second terminal 142 operably coupled with second resistive element 132. In certain embodiments, each terminal 141, 142 can comprise a first, or distal, end extending from body 144 into pipe 122 and, in addition, a second, proximal, end extending outwardly away from body 144. In at least one embodiment, referring to FIG. 11, each terminal can comprise an outer sheath 146, a busbar 143, and an insulative sleeve 148, wherein the insulative sleeve 148 can be positioned intermediate the busbar 143 and the outer sheath 146. In at least one embodiment, a busbar 143 can comprise a long, cylindrical bar, for example, comprised of an electrically conductive material, such as copper, for example, and an insulative sleeve 148 can be comprised of a non-electrically conductive material, such as rubber and/or magnesium oxide ceramic, for example. In certain embodiments, at least one potting compound, such as an adhesive, epoxy resin, polyurethane, silicone, and/or any suitable material, for example, can be used to create a seal, or seals, between the outer sheath 146, busbar 143, and/or insulative sleeve 148. In at least one embodiment, the potting compound can be applied onto and/or within the terminal 141 at both ends thereof or, alternatively, at only one end thereof. Referring to FIG. 11, for example, potting material, or epoxy, 199 can be inserted into both ends of terminal 141. In certain embodiments, the potting material can be fluidic such that it can flow between the busbar 143 and the insulative sleeve 148 and/or between the insulative sleeve 148 and the sidewalls of outer sheath 146. In at least one embodiment, the potting compound can be configured to cure, or at least partially solidify, when it is exposed to heat, light, and/or air, for example. In various embodiments, the terminal block body 144 can comprise one or more apertures, such as apertures 145, for example, which can each be configured to receive at least a portion of an outer sheath 146. In certain embodiments, the outer sheaths 146 of terminals 141, 142 can be welded to terminal block body 144 to support the terminals within the terminal block body 144 and/or create a seal between each outer sheath 146 and the terminal block body 144. In at least one embodiment, outer sheaths 146 and terminal block body 144 can be comprised of steel. In various embodiments, body 144 can be comprised of an electrically insulative, or non-conductive, material.

In various embodiments, referring now to FIGS. 4-7, terminal block 140 can be connected to pipe 122 by a connector, such as collar 150, for example. Collar 150 can comprise an aperture 152 which can be configured to receive an end 129 of pipe 122. In certain embodiments, aperture 152 can comprise a threaded portion 151 which can comprise a set of thread teeth 153 configured to threadably engage a set of thread teeth 128 on pipe 122. In at least one such embodiment, collar 150 can be assembled to pipe 122 by aligning, or at least substantially aligning, aperture 152 with pipe 122 such that collar 150 can be rotated relative to pipe 122 and/or such that pipe 122 can be rotated relative to collar 150. In any event, threaded portion 151 can further comprise a stop, such as stop 154, for example, which can limit the progression of collar 150 onto pipe 122 and allow collar 150 to be tightened onto pipe 122. In various embodiments, referring again to FIGS. 4-7, at least a portion of terminal block 140 can be positioned within aperture 152 of collar 150, wherein, in at least one embodiment, terminal block 140 can further comprise a heating element mounting portion 149 which can be configured to be mount heating element assembly 130 to a mounting portion 159 of collar 150. In at least one such embodiment, heating element mounting portion 149 can comprise a flange which can be mounted to collar mounting portion 159 by one or more fasteners, such as bolts 158, for example. As illustrated in FIG. 5, heating element mounting portion 149 can comprise one or more fastener apertures 147, for example, which can be aligned with one or more threaded fastener apertures 157, for example, in collar mounting portion 159, wherein bolts 158 can be inserted through fastener apertures 147 and threadably engaged with threaded fastener apertures 157 in order to secure terminal block 140 to collar 150.

In use, in various embodiments, first terminal 141 can be operably coupled with the positive, or output, terminal of a voltage power source, for example, while the second terminal 142 can be operably coupled with the negative, or return, terminal of the voltage power source, for example. In certain embodiments, the voltage power source may supply an alternating voltage such that an alternating (AC) current can flow through the resistive elements 131, 132. In addition to or in lieu of the above, a power source can supply a constant voltage such that a direct (DC) current can flow through the resistive elements 131, 132. In at least one embodiment, a power source can supply a standard alternating three-phase 480V voltage. Other voltages, such as alternating three-phase 208V, 240V, 380V, 415V, and/or 575V, voltages, for example, can be supplied. Other embodiments are envisioned in which any suitable poly-phase alternating voltage is supplied. Further still, a single phase alternating voltage can be used. In any event, as outlined above, the current flowing though first resistive element 131 and second resistive element 132 can generate heat. This heat can radiate into the space, or air, surrounding the heating element assembly 130 and can be absorbed by pipe 122 and the fluid 101 surrounding pipe 122 within tank 100. In various embodiments, as described above, resistive elements 131 and 132, for example, can comprise conductors having high resistances which can facilitate the generation of heat therein. In at least one embodiment, such high resistances can be generated when the resistive elements 131, 132 are comprised of conductors having longer lengths, smaller cross-sections, and/or materials having a higher resistivity, such as aluminum and/or nickel chromium, for example.

In various circumstances, further to the above, various combustible vapors or fumes may enter into aperture 126 in pipe 122, especially when the tank 100 contains combustible materials therein. In such circumstances, the combustible vapors or fumes may be ignited by the resistive elements 131, 132 of heating element assembly 130. More particularly, the resistive elements 131, 132 can be sufficiently hot during the operation of heating unit 120 to ignite the vapors or fumes. The ignition of these vapors or gasses, for example, can create large pressure spikes or pulses within the pipe 122. The products of this combustion, or combusted gasses, can expand such that they flow from aperture 126 into a chamber, or volume, 160 defined between collar 150, terminal block 140, and the end of pipe 122, for example. Furthermore, the combusted gasses can pressurize the atmosphere within aperture 126 and push at least a portion of the atmosphere into chamber, or volume, 160.

Figure 8:
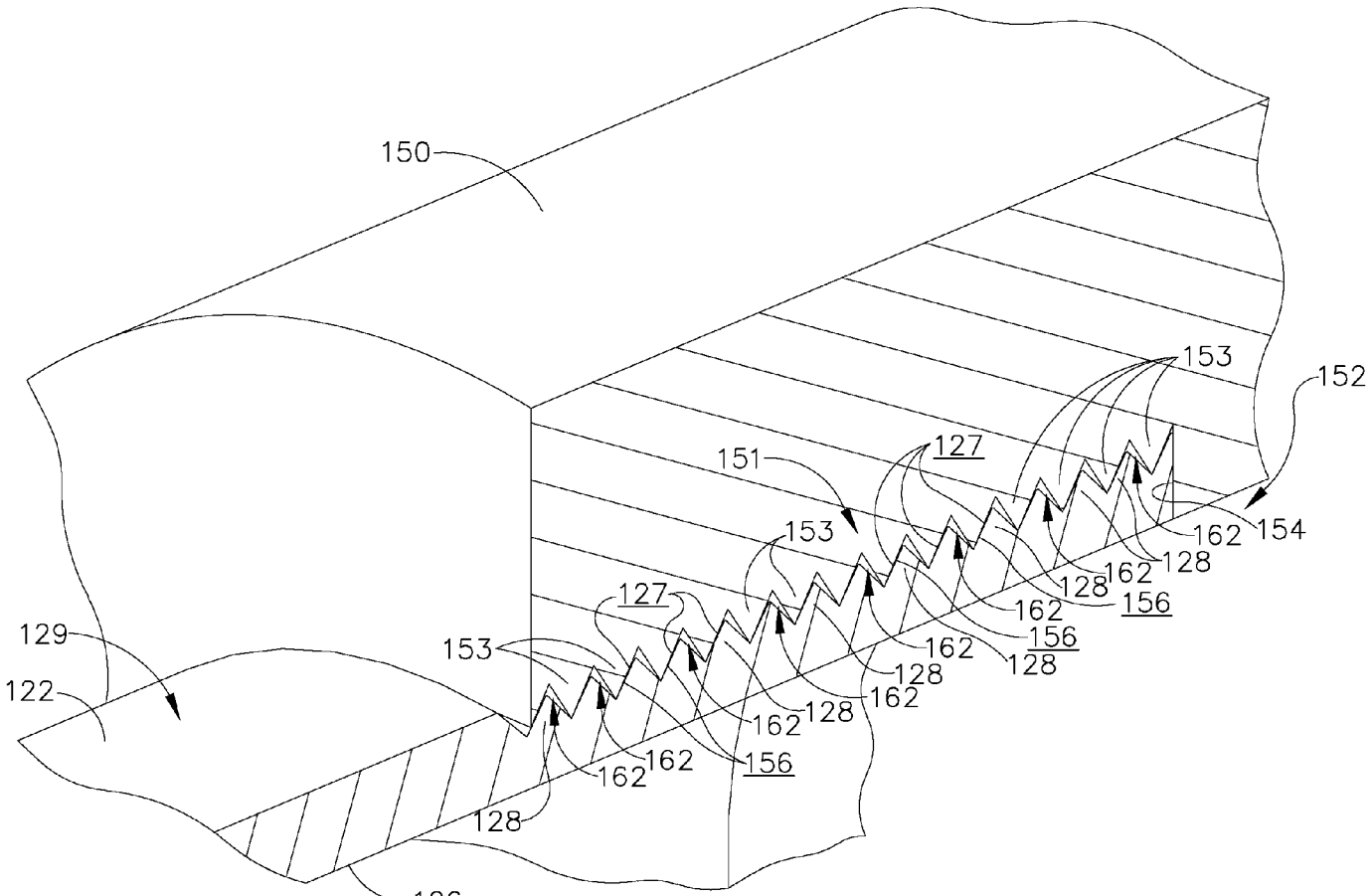
FIG. 8 is a detail view of a first flame path defined between a collar and a pipe of the heating unit of FIG. 1.

In various circumstances, the heating unit 120 can be configured to control and exhaust the combusted materials and/or pressurized atmosphere created by the combustion. In various embodiments, the heating unit 120 can comprise one or more flame paths, or exhaust paths, which can direct the combusted materials and/or pressurized atmosphere along a predetermined path before they are vented to the atmosphere surrounding heating unit 120, for example. In certain embodiments, referring to FIGS. 5-8, a first flame path can be defined between pipe 122 and collar 150, wherein, in various embodiments, the first flame path can be defined between the outer perimeter, or circumference, of pipe 122 and the inner perimeter, or circumference, of collar aperture 152. In at least one embodiment, the first flame path can be defined between the threads 128 on pipe 122 and the threads 153 in collar aperture 152. In such embodiments, referring to FIG. 8, threads 128 and threads 153 can be sized and configured such that gaps, such as gaps 162, for example, can define a passageway between threads 128 and 153. In various embodiments, the contacting surfaces, or faces, 127 of threads 128 and the contacting surfaces, or faces, 156 of threads 153 can be sufficiently engaged with one another such that the combusted gasses and/or pressurized atmosphere cannot flow, or do not substantially flow, between the contact faces 127 and 156. In at least one such embodiment, the combusted gasses and pressurized atmosphere can flow through a circuitous, helical passage comprising gaps 162, wherein the helical passage can be defined between the roots and crests of the mating threads 128 and 153 such that the combusted gasses and/or pressurized atmosphere can cool therein. In embodiments where surfaces, or faces, 127 and 156 are not in contact, or not in full contact, with one another, the combusted gasses and/or pressurized atmosphere can pass between the threads 128 and 153 along a more axial, or direct, path between chamber, or volume, 160 and the atmosphere surrounding heating unit 120. By allowing the combusted gasses to cool in the manner outlined above, in various circumstances, further ignition of the vapors may be avoided.

In various embodiments, further to the above, heating unit 120 can further comprise a second flame path. In at least one embodiment, referring to FIGS. 6 and 9, the second flame path can be defined between collar 150 and terminal block 140. As discussed above, the flange 149 of terminal block 140 can be securely mounted to mounting portion 159 of collar 150 by fasteners 158; although, in various embodiments, the flange 149 may not be sealed to collar 150. More particularly, a gap, or passageway, such as passageway 161, for example, can be defined between flange 149 of terminal block 140 and the mounting portion 159 of collar 150, for example. In such embodiments, the combusted gasses and/or pressurized atmosphere in chamber 160 can vent to the atmosphere surrounding heating unit 120, for example, through passageway 161. In various embodiments, passageway 161 can comprise a first portion 163 which is defined between terminal block body 144 and the sidewalls of aperture 152 and, in addition, a second portion 164 defined between flange 149 and mounting portion 159. In at least one embodiment, the first portion 163 can define a path oriented in a first direction and the second portion 164 can define a path oriented in a second, or different, direction. In at least one such embodiment, the first direction and the second direction can be perpendicular, or at least substantially perpendicular, to one another while, in other embodiments, the first direction and the second direction can be skew and/or arranged in any other suitable manner. In various embodiments, although not illustrated, a flame path may comprise more than two portions oriented in different directions, while, in certain embodiments, a flame path may comprise curved portions in addition to or in lieu of straight portions.

Figure 9:
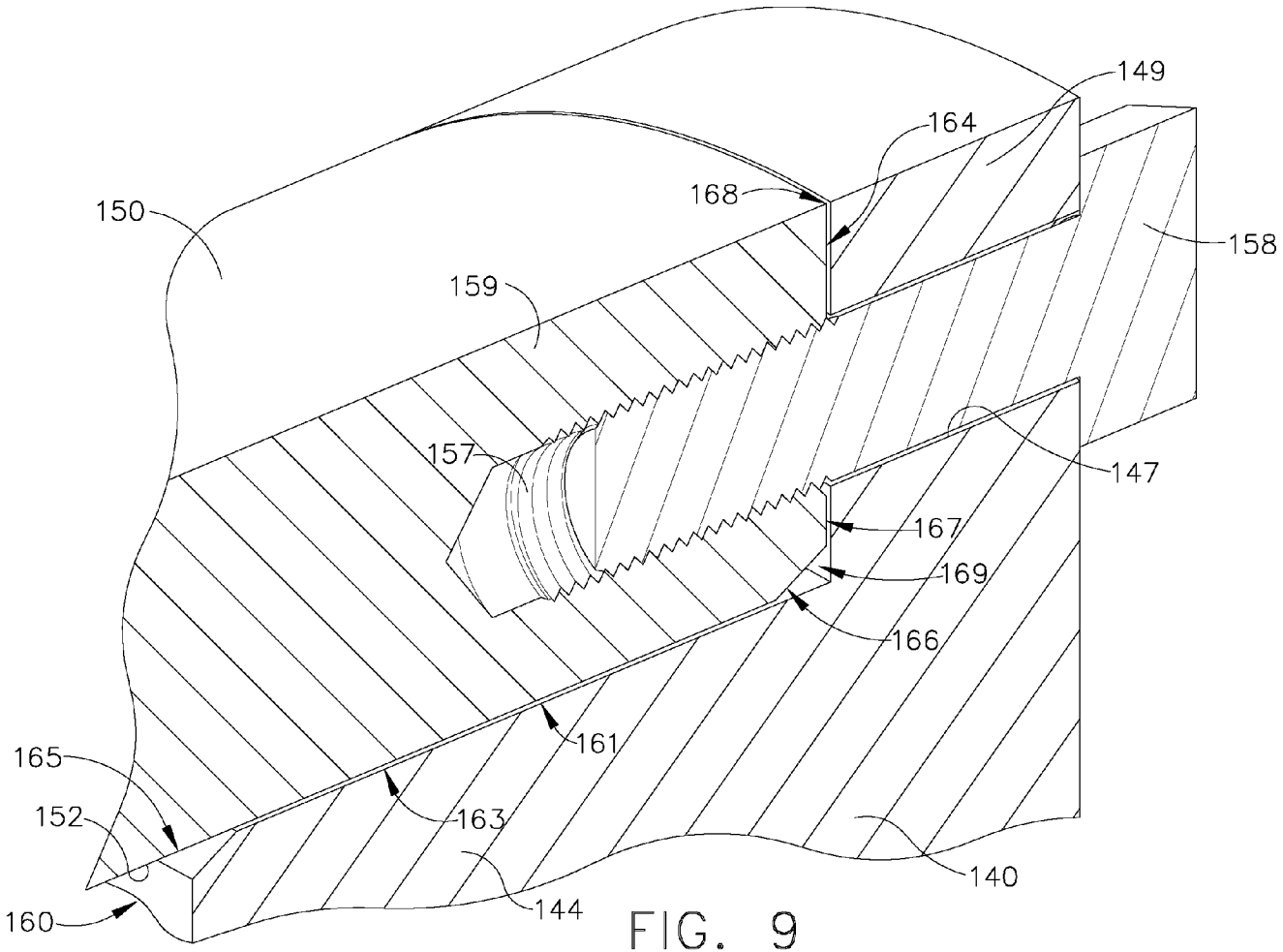
FIG. 9 is a detail view of a second flame path defined between the collar of FIG. 8 and a portion of a heating element of the heating unit of FIG. 1.

In various embodiments, further to the above, the second flame path can be defined between the outer perimeter, or circumference, of terminal block body 144 and the sidewall, or inner circumference, of collar aperture 152. Although the outer perimeter of terminal block body 144 may be cylindrical, or at least substantially cylindrical, and the inner perimeter of collar aperture 152 may be cylindrical, or at least substantially cylindrical, other configurations, such as square configurations, for example, are contemplated. In any event, referring to the illustrated embodiment, the first portion 163 of the second flame path can comprise an annular, or at least substantially annular, passageway which can allow the combusted gasses and/or pressurized atmosphere to flow out of chamber 160 and into the second portion 164 of the second flame path. As illustrated in FIG. 9, the second portion 164 comprises a passageway which extends radially outwardly with respect to the first portion 163 of the second flame path. In at least one such embodiment, the combusted gasses and/or compressed atmosphere can flow from the first portion 163 of the second flame path into the second portion 164 and then flow into the atmosphere surrounding heating unit 120. In at least the illustrated embodiment, the flow of the combusted gasses and/or the compressed air must change directions between chamber 160 and the end of the second portion 164 of the second exhaust path, i.e., at the transition between the first portion 163 and the second portion 164. Such a change in direction can slow down, or decrease the velocity of, the flow of combusted gasses and/or compressed air and/or otherwise allow energy to be removed therefrom. Various embodiments are envisioned in which the flow of combusted gasses and/or compressed air must change directions a plurality of times.

In various embodiments, further to the above, the first portion 163 of the second flame path can be defined by a first gap width, i.e., the distance between the outer perimeter of terminal block body 144 and the inner perimeter of collar aperture 152. In certain embodiments, the first gap width can be constant along the length of first portion 163, i.e., between beginning 165 and end 166. In other embodiments, although not illustrated, the first gap width can change in width along the length of first portion 163. In at least one such embodiment, the first gap width can have a smaller width at the beginning 165 of first portion 163 as compared to its width at end 166. In various circumstances, a first gap width which increases in dimension can allow the combusted gasses and/or compressed air flowing therethrough to cool and/or expand and decompress. Such an increase in width can be linear and/or non-linear. Various other embodiments are envisioned in which the first gap width decreases in dimension between beginning 165 and end 166. In any event, the end 166 of first portion 163 can terminate in a chamber 169 which can allow the combusted gasses and/or atmosphere to cool and/or expand therein. In at least one embodiment, the chamber 169 can be created by placing a bevel on an edge of collar 159.

Similar to the above, the second portion 164 of the second flame path can be defined by a second gap width, i.e., the distance between mounting portion 159 of collar 150 and the flange 149 of terminal block 140. In certain embodiments, the second gap width can be constant along the length of second portion 164, i.e., between beginning 167 and end 168. In at least one embodiment, the second gap width can have the same, or at least substantially the same, width as the first gap width. In other embodiments, although not illustrated, the second gap width can change in width along the length of second portion 164. In at least one such embodiment, the second gap width can have a smaller width at the beginning 167 of second portion 164 as compared to its width at end 168. In various circumstances, a second gap width which increases in dimension can allow the combusted gasses and/or compressed air flowing therethrough to cool and/or expand and decompress. Such an increase in width can be linear and/or non-linear. Various other embodiments are envisioned in which the second gap width decreases in dimension between beginning 167 and end 168. In certain embodiments, referring again to FIG. 9, the second portion 164 of the second flame path can have one or more additional venting paths between fasteners 158 and the sidewalls of apertures 147. In such embodiments, the combusted gasses and/or compressed atmosphere can vent out through these additional venting paths and/or through end 168 of the second portion 164.

In various embodiments, as outlined above, the first flame path between pipe 122 and collar 150 can be defined around the perimeter of pipe 122. In at least one such embodiment, as a result, the first flame path can be circular or circumferential, i.e., defined about the circumference of pipe 122. In various embodiments, as also outlined above, the second flame path between terminal block 140 and collar 150 can be defined around the perimeter of terminal block 140. Similar to the above, as a result, the second flame path can be circular or circumferential, i.e., defined about the circumference of terminal block 140. Although not illustrated, other embodiments are envisioned in which the flame paths of a heating unit are not circular, or at least substantially circular. In at least one embodiment, a flame path can be defined between the perimeters of two adjacent members, such as inner and/or outer perimeters, for example, wherein the perimeters can be square and/or rectangular, for example.

In various embodiments, as described above, a heating unit can comprise a first flame path, or exhaust path, and a second flame path, or exhaust path. In various other embodiments, a heating unit may comprise only the first flame path or only the second flame path. In embodiments comprising only the first flame path, a gasket or seal, for example, can be positioned intermediate collar 150 and flange 149 of terminal block 140 such that the combusted gasses and/or compressed air cannot flow, or at least substantially flow, therebetween. In embodiments comprising only the second flame path, a seal, such as Teflon tape, for example, can be applied to threads 128 and/or threads 153 such that, when collar 150 is threadably engaged with pipe 122, the Teflon tape can be positioned within and obstruct at least a portion of passageway 162 such that the combusted gasses and/or compressed air cannot flow, or at least substantially flow, therebetween. In any event, other embodiments are envisioned which comprise three or more flame paths.

In various embodiments, as described above and referring again to FIGS. 5 and 7, the terminal block 140 comprises a terminal block body 144 having apertures 145 extending therethrough, wherein each aperture 145 can be configured to receive a terminal, such as terminals 141 and 142, for example, therein. As discussed above, at least a portion of terminals 141 and 142, such as an outer sheath 146 (FIG. 11), for example, can be welded to terminal block body 144 to create a seal therebetween. In such embodiments, passageways intermediate the terminals 141 and 142 and the sidewalls of apertures 145 can be sealed, or at least substantially sealed, such that the combusted gasses and/or compressed air cannot flow, or at least substantially flow, therethrough. In certain embodiments, although not illustrated, apertures 145 can have an end which is in fluid communication with chamber 160, wherein combusted gasses and/or compressed air can be exhausted from chamber 160 through passageways positioned intermediate the terminals 141, 142 and the sidewalls of apertures 145. In various circumstances, such passageways can comprise flame paths. In at least one embodiment, although not illustrated, at least one potting compound, such as an adhesive, epoxy resin, polyurethane, silicone, and/or any suitable material, for example, can be used to create a seal between the terminals 141, 142 and the terminal block body 144. In at least one embodiment, although not illustrated, terminal block body 145 can comprise wells, or depressions, for example, surrounding, or at least partially surrounding, apertures 145. In at least one such embodiment, the wells can be configured to receive one or more potting materials therein such that the potting materials can pool within the wells and create a seal between the terminals and the surface of terminal block body 144. In various embodiments, a well can surround each terminal aperture 145. In other various embodiments, a well can surround two or more apertures 145.

In various embodiments, further to the above, the first and second flame paths of heating unit 120 can be configured to control the discharge of combusted gasses and/or compressed atmosphere, wherein, in at least one embodiment, the combusted gasses and/or compressed atmosphere can be vented directly to the atmosphere after having exited the first and second flame paths, for example. In other various embodiments, referring to FIG. 1, heating unit 120 can further comprise an enclosure, such as enclosure 180, for example, surrounding at least a portion of the heating element assembly 130 such that the vented gasses and/or atmosphere are first vented into a chamber, such as chamber 183, for example, within the enclosure 180 before entering into the surrounding atmosphere. In at least one embodiment, collar 150 and terminal block 140 can be positioned within chamber 183 such that the ends of the first and second flame paths are in fluid communication with chamber 183. In certain embodiments, enclosure 180 can comprise a cylindrical, or an at least substantially cylindrical, member having a first, or distal, end 184 mounted to flange, or tank connection member, 124 and a second, or proximal, end which can comprise a bolt plate 185, for example. In at least one such embodiment, the first end 184 can be welded to flange 124 and the bolt plate 185 can comprise one or more bolt holes 186 which can be configured to receive one or more bolts 188 (FIG. 1), and/or any suitable fasteners, configured to mount end plate 187 (FIG. 1) to bolt plate 185. Similar to the above, one or more nuts can be used in connection with bolts 188 in order to secure end plate 187 to bolt plate 185. In certain embodiments, a seal, such as seal 179 (FIG. 5), for example, can be positioned intermediate bolt plate 185 and end plate 187 in order to create a sealing interface therebetween. In at least one such embodiment, seal 179 can be positioned within a circular, or at least substantially circular, groove in bolt plate 185 and/or end plate 187.

In various embodiments, further to the above, enclosure 180 can comprise one or more apertures, such as apertures 189, for example, therein which can be configured to allow the combusted gasses and/or compressed atmosphere which enter into chamber 183 to exit from enclosure 180 into the surrounding atmosphere. In at least one such embodiment, enclosure 180 can also be configured to enclose, or at least partially enclose, the proximal ends 181 and 182 of terminals 141 and 142, respectively, such that the possibility of accidental contact with terminal ends 181 and 182, for example, can be reduced. Referring primarily to FIG. 3, apertures 189 can be sized and configured to allow power supply cables to extend therethrough such that the power cables can be operably connected to ends 181, 182 of terminals 141, 142, respectively, and power can be supplied to the heating unit 120 as described above. In certain embodiments, referring now to FIG. 2, enclosure 180 can further comprise an opening, such as opening 190, for example, which can be sized and configured to allow a sub-assembly comprising terminal block 140, alignment member 138, insulative members 136 and the first and second resistive elements 131 and 132 to be inserted into chamber 183 of enclosure 180, aperture 152 of collar 150, and aperture 126 of pipe 122. Once positioned therein, mounting portion 149 of terminal block 140 can be mounted to mounting portion 159 of collar 150, as described above, and end plate 187 can be mounted to bolt plate 185 of enclosure 180. In at least one such embodiment, the sub-assembly comprising terminal block 140, alignment member 138, insulative members 136, and resistive elements 131, 132 can be slid into aperture 152 and 126 without needing to be rotated therein. Such embodiments may preclude the twisting or turning of the insulative members 136 and resistive elements 131,132 within pipe 122 and thus reduce the possibility of misalignment therebetween.

Once the heating unit 120 has been secured in position, as described above, the heating element can be operated to heat the air within aperture 126 of pipe 122. The heated air can heat the pipe 122 and, owing to contact between the material 101 within the tank 100 and an outside, or heat transfer, surface of the pipe 122, the material can be heated by the pipe. The distal end of pipe 122, although at least partially immersed in the material, can be sealed such that the material does not enter into pipe 122 from the distal end. In various embodiments, referring to FIGS. 3 and 4, heating unit 120 can further comprise an end cap, such as end cap 119, for example, mounted thereto, wherein the cap 119 can be configured to create a fluid-tight seal against pipe 122. In at least one embodiment, end cap 119 can be welded to pipe 122.

Figure 10:
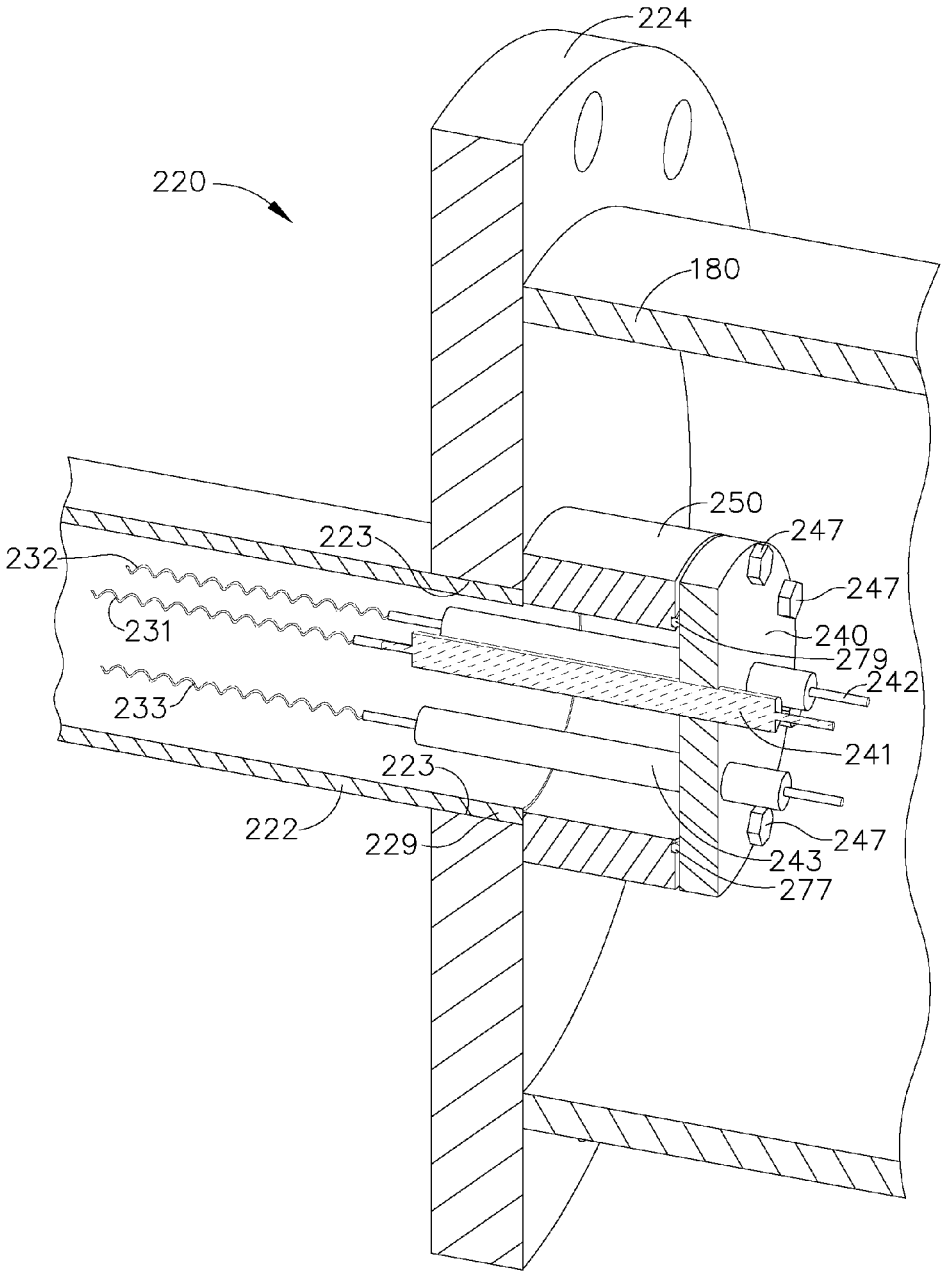
FIG. 10 is a cross-sectional view of a heating unit in accordance with at least one alternative embodiment of the present invention.

In various embodiments, as described above, a heating unit can comprise flame paths which can be configured to vent combustible gasses, for example, which have ignited after coming into contact with one or more resistive elements within the heating unit. In various alternative embodiments, referring now to FIG. 10, a heating unit, such as heating unit 220, for example, can comprise one or more seals which can be configured to prevent combustible gasses, for example, from coming into contact with the resistive elements of the heating unit, such as resistive elements 231, 232, and/or 233, for example, and, as a result, prevent, or at least reducing the possibility of, the combustible gasses from igniting. In at least one embodiment, heating unit 220 can comprise a pipe 222, a mounting flange 224 configured to mount heating unit 220 to a tank, a collar 250, and a terminal block 240 comprising terminals operably engaged with the resistive elements 231, 232, and 233. In at least one such embodiment, an end 229 of pipe 222 can be positioned within an aperture 223 in flange 224 such that flange 224 can be welded and/or brazed to pipe 222 in order to mount flange 224 to pipe 222 and create a seal therebetween. Furthermore, collar 250 can be positioned and aligned with respect to end 229 of pipe 222 and aperture 223 such that collar 250 can be welded and/or brazed to flange 224, and/or pipe 222, in order to mount collar 250 to flange 224 and create a seal therebetween.

In various embodiments, further to the above, terminal block 240 can be assembled to collar 250 such that a sealing interface is created therebetween. In at least one embodiment, referring to FIG. 10 once again, terminal block 240 and collar 250 can comprise one or more bolt holes configured to receive one or more bolts therein, wherein the bolts can be inserted through the bolt holes in terminal block 240 and threadably engaged with the bolt apertures in collar 250. In certain embodiments, the heating unit 220 can further comprise a seal, such as seal 277, for example, which can be positioned intermediate terminal block 240 and collar 250 such that, when bolts 247 are tightened, seal 277 can be compressed between terminal block 240 and collar 250 in order to create a fluid-tight seal therebetween. In various embodiments, seal 277 can be comprised of rubber, plastic, silicone, an elastomeric material, and/or any other suitable material. In certain embodiments, seal 277 can be manufactured as a discrete piece which can be placed intermediate terminal block 240 and collar 250 before terminal block 240 is mounted to collar 250. In at least one such embodiment, the terminal block 240 and/or the collar 250 can comprise one or more grooves configured to receive at least a portion of the seal when it is positioned therein. In various embodiments, although not illustrated, a heating unit can comprise two or more seals positioned intermediate the terminal block 240 and/or the collar 250. In at least one such embodiment, a heating unit can comprise an inner seal and an outer seal positioned intermediate terminal block 240 and collar 250, wherein the inner seal and the outer seal can be concentrically, or at least substantially concentrically, aligned. In any event, in certain embodiments, the seals and/or grooves can be positioned radially inwardly with respect to the bolts 247 such that the bolts 247, and the associated bolt holes, are positioned radially outwardly with respect to the sealing interface created between terminal block 240, collar 250, and seal 277, for example.

In various embodiments, further to the above, the sealing interface created between terminal block 240, collar 250, and seal 277 can be fluid-tight such that air and/or combustible gasses or vapors cannot flow thereby. Similarly, fluid-tight seals can be created between the body of terminal block 240 and terminals 241, 242, and 243. In at least one embodiment, similar to the above, portions of terminals 241, 242, and 243, such as metallic outer sheaths, for example, can be welded to the body of terminal block 240. In certain embodiments, although not illustrated, a seal sleeve can be positioned over one or more of the terminals such that a first sealing interface is created between the sleeve and the terminal block body and, in addition, a second sealing interface is created between the sleeve and the terminal. In any event, the interface between the terminals and the terminal block body can be fluid-tight such that air and/or combustible gasses or vapors cannot flow thereby. As a result of the above, combustible gasses or vapors can be prevented from entering into pipe 222 and, as a result, they can be prevented from coming into contact with the resistive elements and igniting.

In various embodiments, as described above, heating unit 120 comprises two terminals 141, 142 and two resistive elements 131, 132 which can comprise one circuit, or loop. Various other embodiments are envisioned which comprise more than two terminals and/or more than two resistive elements which comprise two or more circuits, or loops. In at least one embodiment, a heating unit can include two terminals and two resistive elements comprising one circuit and can utilize single phase voltage supply. In other embodiments, a heating unit can include four terminals and four resistive elements comprising two circuits utilizing single phase voltage. In at least one embodiment, a heating unit can comprise one circuit utilizing three phase voltage. In certain embodiments, a heating unit can include six terminals and six resistive elements. In various embodiments, a heating element can comprise three terminals and three resistive elements wherein, in at least one embodiment, two terminals, and the resistive elements connected thereto, can be operably coupled with the positive terminal, or pole, of a voltage power supply and the third terminal, and resistive element connected thereto, can be operably coupled with the negative terminal, or pole, of the voltage power supply, for example. In at least one embodiment, the diameters and/or lengths of the resistive elements of a heating unit can be the same or they can be different. In certain embodiments, the materials of the resistive elements of a heating unit can be the same or they can be different.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A heating unit for use with a storage tank, comprising:
- a tube, comprising:
  - a threaded end; and
  - a tube aperture;
- a heating element at least partially positioned within said tube aperture, said heating element comprising:
  - a resistive element configured to generate heat when current flows therethrough;
  - a terminal operably coupled with said resistive element;
  - a terminal block, wherein said terminal is supported by said terminal block, and wherein said terminal is sealingly engaged with said terminal block; and
  - a mounting portion;
- a flange mounted to said tube, wherein said flange is configured to be mounted to the storage tank;
- a collar comprising a collar aperture, wherein at least a portion of said collar aperture is threaded, wherein said collar aperture is threadably engaged with said threaded end of said tube, and wherein said mounting portion of said heating element is mounted to said collar;
- a first flame path defined between said threaded end of said tube and said threaded portion of said collar aperture; and
- a second flame path defined between said collar and said mounting portion of said heating element.

2. The heating unit of claim 1, wherein said terminal comprises a first terminal, wherein said heating unit further comprises a second terminal operably coupled with said resistive element, wherein said second terminal is supported by said terminal block, and wherein said second terminal is sealingly engaged with said terminal block.

3. The heating unit of claim 1, wherein said threaded end of said tube comprises a first circumference, wherein said collar aperture defines a second circumference, and wherein said first flame path is defined between said first circumference and said second circumference.

4. The heating unit of claim 1, further comprising a plurality of fasteners, wherein said heating element mounting portion comprises a plurality of mounting portion fastener apertures, wherein said collar comprises a plurality of collar fastener apertures, and wherein said fasteners are configured to extend through said mounting portion fastener apertures and threadably engage said collar fastener apertures to mount said heating element mounting portion to said collar.

5. The heating unit of claim 1, wherein said second flame path comprises a first portion oriented in a first direction and a second portion oriented in a second direction, and wherein said first direction is different than said second direction.

6. The heating unit of claim 5, wherein said second direction is perpendicular to said first direction.

7. The heating unit of claim 1, wherein said heating element mounting portion comprises a first circumference, wherein said collar defines a second circumference, and wherein said second flame path is defined between said first circumference and said second circumference.

8. A heating unit for use with a storage tank, comprising:

a tube, comprising:

an end; and a tube aperture;

a heating element at least partially positioned within said tube aperture, said heating element comprising:

a resistive element configured to generate heat; and a heating element mounting portion;

a tube mounting portion extending from said tube, wherein said tube mounting portion is configured to be mounted to the storage tank; and a collar comprising a collar aperture defined by a sidewall, wherein said end of said tube is positioned within said collar aperture, wherein said tube and said sidewall of said collar aperture define a first flame path, and wherein said collar and said heating element mounting portion define a second flame path.

9. The heating unit of claim 8, wherein said heating element further comprises:

a terminal block;

a first terminal operably coupled with said resistive element, wherein said first terminal is supported by said terminal block, and wherein said first terminal is sealingly engaged with said terminal block; and a second terminal operably coupled with said resistive element, wherein said second terminal is supported by said terminal block, and wherein said second terminal is sealingly engaged with said terminal block.

10. The heating unit of claim 8, wherein said end of said tube comprises a first set of threads, wherein said collar aperture comprises a second set of threads, and wherein, when said first set of threads is threadably engaged with said second set of threads, said first flame path comprises a passage intermediate said first set of threads and said second set of threads.

11. The heating unit of claim 8, wherein said end of said tube comprises a first circumference, wherein said collar aperture sidewall defines a second circumference, and wherein said first flame path is defined between said first circumference and said second circumference.

12. The heating unit of claim 8, wherein said second flame path comprises a first portion oriented in a first direction and a second portion oriented in a second direction, and wherein said first direction is different than said second direction.

13. The heating unit of claim 12, wherein said second direction is perpendicular to said first direction.

14. The heating unit of claim 8, wherein said heating element mounting portion comprises a first circumference, wherein said collar defines a second circumference, and wherein said second flame path is defined between said first circumference and said second circumference.

15. A heating unit for use with a storage tank, comprising:

a tube comprising a tube aperture;

a heating element at least partially positioned within said tube aperture, said heating element comprising:

a resistive element configured to generate heat; and a heating element mounting portion;

a tube mounting portion extending from said tube, wherein said tube mounting portion is configured to be mounted to the storage tank; and a connector, wherein said connector is mounted to said tube, wherein said heating element mounting portion is mounted to said connector, wherein said tube and said connector define a first flame path, and wherein said connector and said heating element mounting portion define a second flame path.

16. The heating unit of claim 15, wherein said heating element further comprises:

a terminal block;

a first terminal operably coupled with said resistive element, wherein said first terminal is supported by said terminal block, and wherein said first terminal is sealingly engaged with said terminal block; and a second terminal operably coupled with said resistive element, wherein said second terminal is supported by said terminal block, and wherein said second terminal is sealingly engaged with said terminal block.

17. The heating unit of claim 15, wherein said tube further comprises a first set of threads, wherein said connector comprises a second set of threads, and wherein, when said first set of threads is threadably engaged with said second set of threads, said first flame path comprises a passage intermediate said first set of threads and said second set of threads.

18. The heating unit of claim 15, wherein said tube comprises a first circumference, wherein said connector defines a second circumference, and wherein said first flame path is defined between said first circumference and said second circumference.

19. The heating unit of claim 15, wherein said second flame path comprises a first portion oriented in a first direction and a second portion oriented in a second direction, and wherein said first direction is different than said second direction.

20. The heating unit of claim 19, wherein said second direction is perpendicular to said first direction.

21. The heating unit of claim 15, wherein said heating element mounting portion comprises a first circumference, wherein said connector defines a second circumference, and wherein said second flame path is defined between said first circumference and said second circumference.

22. A heating unit for use with a storage tank, comprising:

a pipe comprising a pipe aperture;

a heating element at least partially positioned within said pipe aperture, said heating element comprising:

a resistive element configured to generate heat; and a heating element mounting portion;

a pipe mounting portion extending from said pipe, wherein said pipe mounting portion is configured to be mounted to the storage tank; and connection means for connecting said heating element mounting portion to said pipe; a first exhaust path defined between said pipe and said connection means; and a second exhaust path defined between said connection means and said heating element mounting portion.

23. A storage tank, comprising:

a chamber;

a chamber wall at least partially surrounding said chamber;

an aperture in said chamber wall; and a heating unit positioned within said aperture, said heating unit comprising:

a tube comprising a tube aperture;

a heating element at least partially positioned within said tube aperture, said heating element comprising:

a resistive element configured to generate heat; and a heating element mounting portion;

a tube mounting portion extending from said tube, wherein said tube mounting portion is mounted to said chamber wall; and a connector, wherein said connector is mounted to said tube, wherein said heating element mounting portion is mounted to said connector, wherein said tube and said connector define a first flame path, and wherein said connector and said heating element mounting portion define a second flame path.

24. A heating unit for use with a storage tank, comprising:

a heating element at least partially positionable within a tube mounted to the storage tank, said heating element comprising:

a resistive element configured to generate heat; and a heating element mounting portion; and a connector, wherein said connector comprises a threaded portion mountable to the tube, wherein said heating element mounting portion is mounted to said connector, wherein said tube and said connector define a first flame path when said connector is mounted to the tube, and wherein said connector and said heating element mounting portion define a second flame path.

* * * * *